United States Patent [19]

Ohno

[11] 4,058,637

[45] Nov. 15, 1977

[54] ELECTROSTATIC DEVELOPING METHOD

[75] Inventor: Genji Ohno, Yokohama, Japan

[73] Assignee: Research and Development Laboratories of Ohno Co., Ltd., Yokohama, Japan

[21] Appl. No.: 604,098

[22] Filed: Aug. 13, 1975

Related U.S. Application Data

[60] Continuation of Ser. No. 398,962, Sept. 20, 1973, abandoned, Division of Ser. No. 227,025, Feb. 17, 1972, Pat. No. 3,894,512.

[30] Foreign Application Priority Data

Feb. 18, 1971 Japan ..... 46-7076

[51] Int. Cl.[2] ..... G03G 13/10

[52] U.S. Cl. ..... 427/15; 96/1 LY; 118/644

[58] Field of Search ..... 427/15, 17; 96/1 LY; 118/637, DIG. 23, 644, 661; 355/10

[56] References Cited

U.S. PATENT DOCUMENTS

| | | | |
|---|---|---|---|
| 3,096,198 | 7/1963 | Schaffert | 427/15 |
| 3,220,833 | 11/1965 | McFarlane | 118/637 |
| 3,472,676 | 10/1969 | Cassiers et al. | 427/15 |
| 3,486,922 | 12/1969 | Cassiers et al. | 427/15 |
| 3,561,358 | 2/1971 | Weigl | 96/1 LY |
| 3,727,758 | 4/1973 | Saito et al. | 427/15 |
| 3,743,408 | 7/1973 | Ohno | 355/10 |
| 3,801,315 | 4/1974 | Gundlach et al. | 961/1 LY |
| 3,894,512 | 7/1975 | Ohno | 118/644 |

*Primary Examiner*—Harry J. Gwinnell
*Assistant Examiner*—Stuart D. Frenkel
*Attorney, Agent, or Firm*—Staas & Halsey

[57] ABSTRACT

Method is disclosed for developing electrostatic latent images, utilizing a developer supply unit formed of a liquid repellent layer having a thickness in the range of 3μ to 400μ (preferably 5μ to 330μ), and a substrate, and having uniformly distributed pores disposed therethrough. A liquid developer is supplied to the back surface of this unit, and an exposing unit is disposed to form electrostatic latent images onto the front surface of the developer supply unit. As a result, the liquid developer applied to the back surface of the liquid repellent layer is distributed on the front surface by the action of the electric field established by the latent image.

3 Claims, 7 Drawing Figures

ELECTROSTATIC DEVELOPING METHOD

This is a continuation of application Ser. No. 398,962 filed Sept. 20, 1973, now abandoned, which is a division of application Ser. No. 227,025, filed Feb. 17, 1972, now U.S. Pat. No. 3,894,512.

BACKGROUND OF THE INVENTION

1. Field of the Invention

This invention relates to methods of developing electrostatic, latent images and corresponding developing apparatus, and in particular to those methods of liquid development.

2. Description of the Prior Art

Known methods have been used to develop electrostatic latent images formed on the surface of a photoconductive insulating plate or an insulating film. Typically, an electrostatic image is formed on the insulating member, and the image is developed by charged, colored particles adhering to the electrostatic latent images. Such methods employing dry developers have such defects as the scattering of the colored particles and the use of complex and expensive apparatus. In such methods the use of liquid developers incurs the risk of fire, and the liquid developer may be poisonous and have an objectionable odor. Typically, liquid developers require the use of an organic solvent which has a high resistance and low dielectric constant. The liquid development method is satisfactory in providing copies of high resolution compared with dry development methods, but those portions where no image appears on the latent image forming unit may be contaminated because the whole surface of this unit receives the liquid developer. Further, a liquid developer requires a hot drying process after developing or the use of a low boiling point solvent.

SUMMARY OF THE INVENTION

It is therefore an object of this invention to provide a developing method overcoming these defects of the known methods.

It is a further object of this invention to provide a new liquid, electrostatic, latent image developing method and its corresponding apparatus which reduces the risk of fire and does not require the use of a liquid developer having poisonous character or an objectionable odor.

It is a still further object of this invention to eliminate the drying processes and to apply liquid developer only to the latent image without damping the whole surface of the latent image forming unit.

These and other objects of this invention are accomplished by providing a method of developing images in which the developer adheres only to those portions where the latent images have been formed without damping the other portions of the latent image forming unit. In particular, the liquid developer is applied to the back of a developer supply unit and is prevented from exuding onto the unit surface due to a liquid repellent surface provided by a layer of this unit. Thus, the liquid developer does not adhere to those portions of the surface of the electrostatic latent image forming unit, comprised illustratively of a photoconductive sensitive plate or an insulating film where no electrostatic latent image exists. Conversely, the developer exudes from the surface of the developer supply unit, and adheres to those portions of the plate surface where the latent image has been established. The liquid developer is absorbed and developes these portions of the surface, because of the electrostatic polarization or induction of the developer by the electric charges of the latent images. The electrostatic, latent image lowers the contact angle between the developer and the liquid repellent layer, upon those portions where the electrostatic latent image has been established.

Illustratively, a developer supply unit has a liquid repellent layer of 3μ to 400μ thickness (5μ to 330μ thickness is preferable) disposed on a surface of a porous substrate except for the portions of the minute pores. The porous substrate is disposed to confront a photoconductive, sensitive plate or an insulating film upon which the electrostatic latent images are established. The sensitive plate has a plurality of pores distributed uniformly at close spacings, over the entire surface thereof; the openings are penetrated from the back to the front surface openings.

As a result of this invention, it is not required to have such high resistance and low dielectric constant as the carrier liquid of the charged, fine particles used in the conventional methods. Therefore, the developer of this invention could be water, or other incombustible, odorless and innoxious solutions containing water.

BRIEF DESCRIPTION OF THE DRAWINGS

While the specification concludes with claims particularly pointing out and distinctly claiming the subject matter which is regarded as the invention, a preferred embodiment is disclosed in the following detailed description taken in conjunction with the accompanying drawings, in which:

DETAILED DESCRIPTION OF THE PREFERRED EMBODIMENTS

Figure 1:
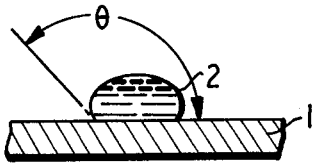
FIG. 1 is a cross-sectional view of the contact angle of a liquid drop on the surface of a liquid repellent film.
Figure 2:
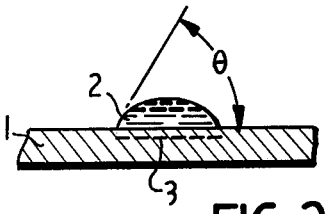
FIG. 2 is a cross-sectional view of the change of the said contact angle, when the liquid repellent film is charged.

Referring now to FIG. 1, there is shown a liquid drop 2 of water disposed on an uncharged liquid repellent film 1. The contact angle $\theta$ between the film surface uncharged and the drop is greater than 90° and the film surface is not wetted. Referring to FIG. 2, however, the liquid repellent insulating film is charged; as a result the contact angle $\theta$ decreases to less than 90°, and the liquid drop is able to wet the film surface. The wetting effect is dependent upon the liquid repellent intensity of the film surface, the kind of liquid, and the applied voltages. When a water drop is placed on a film of 3-fluoro ethylene chloride resin, for example, the contact angle $\theta$ of an uncharged film is 108°. When a film of this material is charged to −500V, the angle $\theta$ decreases to 56° and the film surface is wetted.

Figure 3:
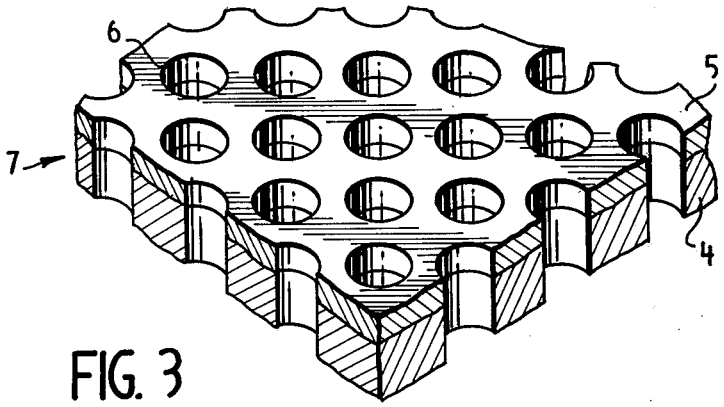
FIG. 3 is a perspective, enlarged view of a fine porous developer supply unit in accordance with the teachings of this invention.

FIG. 3 is a perspective view of a developer supply unit used in accordance with the teachings of this invention. A layer 5, is a material that is hydrophobic with respect to the aqueous liquid developer and consequently liquid repellent. The layer 5 has a specified thickness and is disposed on a substrate 4. The substrate is formed of a material that is hydrophilic with respect to the liquid developer. The layer 5 and the substrate 4 form a composite assembly. A plurality of minute pore openings 6 extend through the composite assembly and are distributed uniformly at close spacings over the entire surface thereof. The composite assembly shown in FIG. 3 is utilized as a developer supply unit 7.

Figure 4:
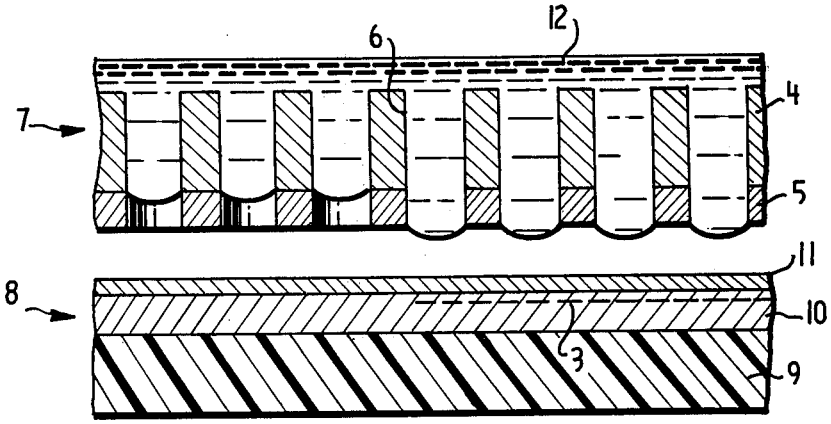
FIG. 4 is a cross-sectional view of the developer supply unit shown in FIG. 3.

FIG. 4 shows the arrangement of the liquid developer supply unit 7 indicated in FIG. 3 in relation to an electrostatic-latent image forming unit 8. The electrostatic latent image forming unit 8 is a sensitive plate composed basically of a conductive supporting substrate 9, a photoconductive layer 10, and an insulating layer 11, as illustratively described in U.S. patent application Ser. No. 528,624, now abandoned. The photosensitive plate 8 may be charged with electrostatic latent images 3 (indicated by dotted lines), and disposed in the front of the developer supply unit 7.

Now, the substrate 4 of the unit 7 is selected properly so that the contact angle of the developing liquid therewith is less than 90° to thereby wet the substrate surface. Also, the characteristics of the liquid repellent layer 5 is selectively chosen that the contact angle of the developing liquid exceeds 90° in the absence of a charge, but becomes less than 90° in the presence of a weak electric field to permit the surface of the liquid repellent layer to be wetted.

In the image developing process, the liquid developer is supplied from the back surface of the developing supply unit 7, whereby the developer enters the minute pores 6 of the substrate 4 to be selectively directed to the liquid repellent surface of layer 5. In particular, the flow of the developer through the pores 6 is retarded to a greater extent at those portions of the unit 7 where no electrostatic latent image has been established. Conversely, the liquid developer is drawn through the minute pores 6 of the substrate 4 under the influence of the charges of the latent images, which generate an electrostatic induction or an electrostatic polarization to attract the liquid developer. At the same time, the contact angle $\theta$ of the liquid developer with respect to the liquid repellent layer is decreased at those portions of the unit 7 adjacent to the electrostatic images formed on the unit 8. The developer, therefore, wets the inside of the minute pores 6 of the liquid repellent layer 5 to exude onto the surface of this layer 5. As mentioned above, the liquid repellent layer 5 of the developer supply unit 7 entirely restricts developer flow at the portions disposed adjacent to those portions of unit 8 where no latent image is formed, and causes the developer to exude onto those portions adjacent to the latent image.

The thickness of the liquid repellent layer is selected in the range of 3μ to 400μ, and is preferably determined to be from 5μ to 330μ. When the thickness of the liquid repellent layer is less than 3μ, the surface portions which are not opposite to a latent image are often contaminated by fine dust and other particles adhering to the minute pores, to effect thereby the uniformity of liquid flow through the minute pores and/or to interrupt the smooth surface of the latent image forming unit. When this thickness exceeds 400μ, the effect of the charge of the latent image is weakened and sufficient developer flow does not readily occur. The optimum thickness of the liquid repellent layer varies with the quantity of the charges of the latent images, the velocity of the developer flow, the viscosity of the developer, the dielectric constant and the electric resistance of the developer, the surface tension of the developer and the distance between the developer supply unit and the surface of the latent image, etc. According to results of conducted experiments, good results may be obtained when the thickness of the liquid repellent layer is selected in the range of 5μ to 330μ.

When the liquid developer supply unit 7 is contacted with or closely spaced from the electrostatic latent image forming unit 8, the developer exuded onto the surface of the liquid repellent layer 5 is attracted to those surface portions of the unit 8 corresponding to the latent image, to thereby develop the latent images. As mentioned above, the developer does not come into contact with the surface of the latent image forming unit where no latent image appears. Therefore, the latent image forming unit does not necessarily require a surface having a liquid repelling property; therefore, various types of latent image forming units may be used in this invention.

The size of the minute pores or openings of the substrate of the liquid developer supply unit varies with the resolution of the copied image required and is selected in the range of 10μ to 100μ and is preferably chosen to be in the range of 10μ to 50μ for business copy. The spacing between pores is selected in the range of 10μ to 100μ. When the size of a minute pore becomes less than 10μ, the pores are blocked with accumulations of developers when the developer supply unit is used repeatedly. When the pore diameter is greater is greater than 100μ, the liquid repelling force of the layer becomes weak and the portions of the surface of this layer where no latent image exists become contaminated and the printed image becomes visually rough.

The substrate with minute pores, may be easily made by well-known methods of manufacturing a metallic porous filter by perforating the minute pores of the desired sizes on the entire surface, or by photoetching on a copper (or other suitable metallic) plate; alternatively a metallic mesh with interstices of the desired size may also be used as the substrate of the invention.

The substrate 4 may be made liquid repellent: (1) by spraying to form the coating; (2) by connecting the substrate to one polarity of a DC power source, and (3) by applying electric charges of opposite polarity to the sprayed liquid particles at the time when the solution such as polyethylene polystyrene, alkyd resin or silicone varnish, etc., is being sprayed thereon. When the composing liquid of the developer is water or contains water, the coating may be formed by applying a thin film of oil and fat such as mineral oil, wax, etc., onto the surface of the substrate.

In addition to the materials mentioned above, those materials having a contact angle with respect to the liquid component of the developer, is over 90° with no charge and is less than 90° under the effect of the electric charges of the latent image, and can be used to form the liquid repellent layer of this invention.

The developer of this invention is composed of a liquid as main agent and of such agents to adjust coloring, surface tension, and viscosity, etc. The composing liquid of the developer must have an affinity with the substrate, to achieve a contact angle not less than 90° to the liquid repellent surface of the developer supply unit, and less than 90° when exposed to the effects of the electric charges of the latent image to permit wetting of the liquid repellent layer on the surface portions adjacent to the latent images of the latent image forming unit. Water, glycerine, ethylene, glycol, etc. are suitable for use as the composing liquid of the developer, when the materials of the liquid repellent layer are polyethylene, polysylene, 4-fluoro ethylene, 3-fluoro ethylene chloride, silicone varnish, and alkyd resin.

The coloring agent may be disposed in either a liquid state or in a suspension state, or may be the mixture of both states. If the developer liquid is water or includes water as a component such water-soluble dyes as malachite green, methyl violet, victoria blue, persian orange, etc., may be used. If the developer liquid includes alcohol, such alcohol-soluble dyes as pigment green, carmine FB, etc. may be used.

The surface tension adjusting agent is employed to adjust the optimum contact angle according to the properties of the liquid repellent layer and the developing velocity, and is adjusted by mixing two kinds of liquid having different surface tension, or by utilizing a very small amount of a well known surface active agent.

The viscosity adjusting agent is added to adjust the liquidity of the developer according to the developing velocity. However, if the developer liquid is water or includes water as a component, a liquid soluble resin such as polyvinyl alcohol, dextrin, methyl melamin, etc., may be added with the solution state. The viscosity adjusting agent can also serve to fix the coloring agent when the developer drys after being transferred to the electrostatic latent image forming unit or to a piece of blank print paper (medium).

The electrostatic latent image, which is developed in accordance with the method of this invention, may be applied to many different electrostatic reproducing processes such as the method wherein images are formed by an electric discharge on the surface of an insulating film, etc., or the method wherein a latent image is formed by electric charge or light irradiation onto a photoconductive sensitive plate composed of zinc oxide, cadmium sulfide, selenium, organic semiconductor, etc. The latent images however, must be maintained at least until the development is performed. For this reason, the methods of forming an electrostatic latent image by distributing internal electric charges or space electric charges, as described in Japanese patent publications No. 23, 910/1967, No. 1552/1968, and No. 6385/1969, or by the PIP method may be preferred.

Figure 5:
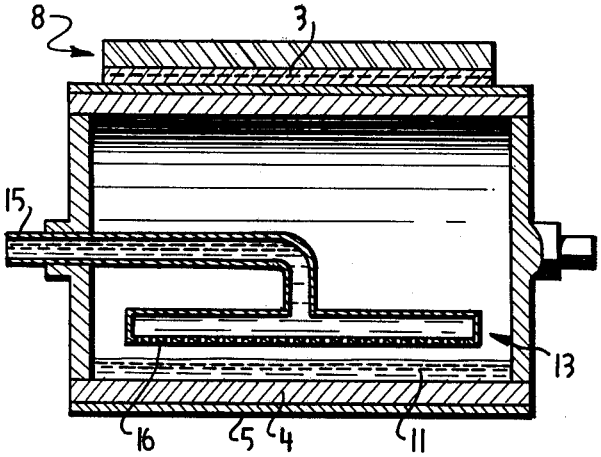
FIG. 5 is a cross-sectional view of an embodiment of the invention.
Figure 6:
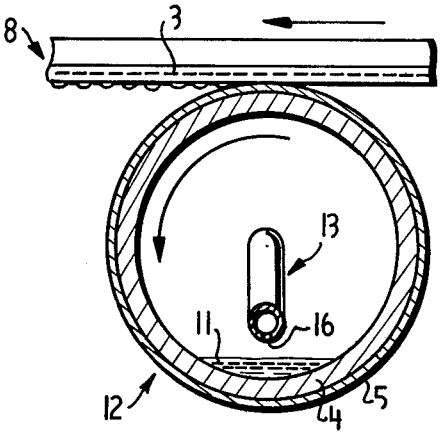
FIG. 6 is a further cross-sectional view of the embodiment shown in FIG. 5.
Figure 7:
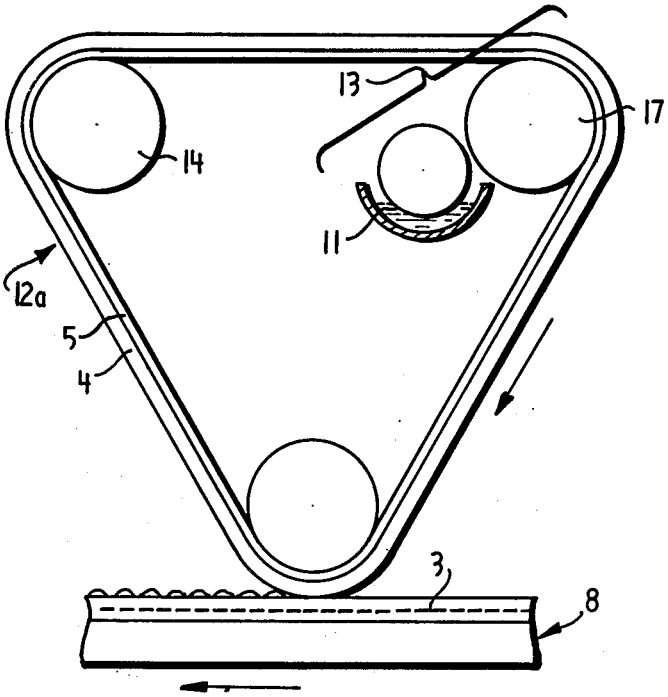
FIG. 7 is a side view of another embodiment of this invention.

FIG. 5 shows an embodiment of the developing apparatus of the invention, having a developer supply unit of cylindrical configuration. FIG. 6 is a cross-section view of the embodiment shown in FIG. 5. FIG. 7 shows an embodiment of the developer supply unit including an endless belt member.

In FIGS. 5, 6 and 7, like numbers will be used to designate corresponding elements. Unit 13 supplies the developer to the inside surface of a cylindrical unit 12 or endless belt developer supply unit 12*a*. In turn the units 12 and 12*a* supply the liquid developer through the pores to selected portions of the surface of the repellent layer 5. As noted above, the repellent layer 5 is disposed over the entire surface of the porous substrate 4 except for those portions of the fine pores.

As shown in FIGS. 5 and 6, the unit 13 causes the developer to drain from a small hole 16 located at the tip of a pipe 15 which is disposed along the axis of the unit 12. In FIG. 7 the developer is supplied to the back surface of a flexible belt 12*a* by a roller 17 which is employed to draw developer from a reservoir thereof and apply it to the back surface of the flexible belt 12*a*. It is noted that both units 12 and 12*a* include the porous substrate 4 and the repellent layer 5.

When the developer supply unit 12 is rotated in the direction of the arrow by a driving device (not shown), the unit 12 applies the developer from its back surface to those portions of its front surface opposite the electrostatic latent images formed on the image forming unit 8. As the unit 8 is moved in the direction shown by the arrow and the units 12 and 12*a* rotate, successive portions of the latent image are brought in close relation to the developer supply unit 12 to thereby transfer the developer onto those surface portions of the unit 8 charged with the latent image.

EXAMPLE 1.

The porous substrate of 3-mm thickness was made by pressing and sintering brass powder having grain diameters in the order of 50μ. The surface of the substrate was ground smoothly, and openings or pores disposed there through having a mean diameter in the order of 14μ. The substrate was connected to an electrode of 1 KV D.C. source while the other source electrode is connected to a spray nozzle. A silicone varnish (with 5% parts of resin) is sprayed by the nozzle to be electrodeposited on the substrate; the dried varnish forms the liquid repellent layer of about 60μ thickness. This substrate was used as a developer supply unit.

Next, a liquid developer, composed of

Methylene blue—6 g
Polyvinyl alcohol (3% solution)—50cc
Water—50cc was supplied uniformly to the back of the supply unit. Next, the surface of the liquid repellent layer of this unit was press-contacted with a zinc oxide sensitized paper, upon which the electrostatic latent image was formed. The parts of the latent images were developed onto the sensitized paper as clear blue images corresponding to the original picture image.

EXAMPLE 2

A liquid repellent layer of 8μ thickness was made by the same method as the Example 1 on one surface of a brass screen of 30 cm width and 250 meshes; the covering screen was used as the endless developer supply unit 12*a* of the FIG. 7. A developer composed of:

Carbon black—7g
Victoria blue—0.15g
Gelatin—2g
Glycerine—15g
Water—100cc was supplied to the inside surface of the thus covered screen.

The latent image forming unit 8 was formed in the following manner. A coating material composed of:

Cadmium sulfide activated by copper—90g
Vinyl chloride—20g
Xylene—50cc
Dichlrol ethane—10cc was coated and dried to a thickness of about 100μ on an aluminum plate of about 2 mm thickness. Further, a polyester layer of about 8μ thickness was formed on this plate, to provide a space charge type of photoconductive sensitive plate. the electrostatic latent image formed on the above sensitive plate by well-known methods, was developed with the developer supply unit 12*a* at a speed of 5 cm per second; a clear, blue-black image was obtained.

EXAMPLE 3

As in Example 2, a benzol solution of low molecular weight polyethylene was electrodeposited by the method set out in Example 1, on the surface of a substrate perforated by minute pores having a diameter of about 50μ. The pores were formed by photoetching to a density of 100 pores per $mm^2$ through a copper plate of 50μ thickness. Next, the substrate was heated sufficiently, fused, and adhered to provide the developer supply unit 12. Using this supply unit 12, electrostatic latent images formed on a zinc oxide sensitized paper were developed at the speed of 7 cm per second by a developer composed of, Victoria blue—3g
Persian orange—5g
Methylol melamine—5g
Water—100cc A clear image was obtained on the zinc oxide print medium.

Numerous modifications and adaptations of the system of the invention will be apparent to those skilled in the art and thus it is intended by the dependent claims to cover all such modifications and adaptions as fall within the true spirit and scope of the invention.

What is claimed is:

1. A method of electrostatically printing an original image with a liquid developer onto an image bearing medium which comprises the steps of:

providing a composite assembly having opposite facing first and second surfaces respectively defined by a first layer, which is hydrophilic with respect to said liquid developer, and a second layer which is hydrophobic with respect to said liquid developer and disposed upon said first layer to form said composite assembly, said composite assembly having a plurality of uniformly distributed fine pores extending therethrough from said first surface to said second surface, the size of said fine pores are in the range of 10μ to 100μ, the thickness of said second layer being in the range of 3μ to 400μ and so selected as to prevent said liquid developer from easily entering into the pores of said second layer;

supplying said liquid developer to said first surface of said composite assembly to flow into the pores of said first layer;

disposing an image bearing medium, having an electrostatic latent image formed thereon, adjacent to said second surface on said composite assembly so that portions of said second surface of said composite assembly are exposed to the electric field emanating from said electrostatic latent image formed on corresponding portions of said image bearing medium thereby causing the liquid developer in pores of said first layer to wet the inside surfaces of corresponding ones of the pores of said second layer in said exposed portions to flow therethrough and to exude onto said exposed portions of second surface thereof; and contacting said image bearing medium with said composite assembly to transfer the liquid developer on said exposed portions of said second surface of said composite assembly onto said electrostatic latent image formed on corresponding portions of said image bearing medium.

2. An electrostatic method for developing latent images of a photoconductive member with a liquid developer containing a coloring material in a water-containing carrier, comprising the steps of:

providing the liquid developer to a developer supply unit having a substrate with a layer of liquid-repellent material disposed thereon, said layer of liquid-repellent material having a thickness in the range of 3μ to 400μ, said developer supply unit having a plurality of pores through the substrate and said layer of liquid-repellent material, the size of said pores being in the range of 10μ to 100μ, said substrate being hydrophilic with respect to the liquid developer, said layer of liquid-repellent material having the characteristic of forming a contact angle in said pores greater than 90° with said liquid developer in the absence of an electrostatic field and less than 90° in the presence of an electrostatic field;

contacting a photoconductive member, having an electrostatic latent image formed thereon, with said layer of liquid-repellent material of said developer supply unit and thereby flowing the liquid developer through said pores adjacent said latent image by lowering said contact angle in said pores of said layer of liquid-repellent material to less than 90°.

3. A method of electrostatically printing an image on an electrostatic image bearing medium with a liquid developer comprising the steps of:

providing a composite assembly having opposite facing first and second surfaces respectively corresponding to a surface of a substrate which is hydrophilic with respect to said liquid developer and a layer of material which is hydrophobic with respect to said liquid developer, disposed upon said substrate to form said composite assembly, said composite assembly having a plurality of uniformly distributed fine pores extending through said substrate and said layer to provide communication between said first and second surfaces, the size of said fine pores being in the range of 10μ to 100μ, the thickness of said second layer being in the range of 3μ to 400μ;

supplying said liquid developer to said first surface of said composite assembly to flow said developer into the pores of said first layer;

disposing an image bearing medium, having an electrostatic latent image formed thereon, adjacent to said second surface of said composite assembly so that portions of said second surface of said composite assembly are exposed to the electric field emanating from corresponding portions of said electrostatic latent image formed on said image bearing medium;

said hydrophobic property of said layer being such that a contact angle greater than 90° is formed in the pores of said layer with respect to said supplied liquid developer when not exposed to an electric field and said property being such that a contact angle less than 90° is formed in said pores with respect to said supplied liquid developer when exposed to an electric field;

said step of disposing an image bearing medium causing the liquid developer in pores of said substreate to wet the inside surfaces of corresponding ones of the pores of said hydrophobic layer in said exposed portions to flow therethrough;

contacting said image bearing medium with said composite assembly to transfer the liquid developer on said exposed portions of said second surface of said composite assembly onto said electrostatic latent image formed on corresponding portions of said image bearing medium.

* * * * *

UNITED STATES PATENT OFFICE

CERTIFICATE OF CORRECTION

Patent No. 4,058,637 Dated November 15, 1977

Inventor(s) Genji Ohno

It is certified that error appears in the above-identified patent and that said Letters Patent are hereby corrected as shown below:

Column 4, line 32, delete "is greater" (first occurrence)
Column 9, line 2, "substreate" should be -- substrate --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*